United States Patent [19]

LeBlanc

[11] Patent Number: 4,832,215

[45] Date of Patent: May 23, 1989

[54] BOTTLE FOR DISPENSING VISCUOUS FOODSTUFF

[76] Inventor: Kenneth T. LeBlanc, 21 Phelan St., Plainville, Conn. 06062

[21] Appl. No.: 128,039

[22] Filed: Dec. 3, 1987

[51] Int. Cl.[4] ..... B65D 1/06; B65D 23/10; B65D 85/72

[52] U.S. Cl. ..... 215/100 A; 220/94 A; 222/475; 222/478

[58] Field of Search ..... 215/100 R, 100 A, 2, 215/1 C, 1 R; 220/94 A; D 9/373, 374, 376, 444; 222/465.1, 475, 478

[56] References Cited

U.S. PATENT DOCUMENTS

| | | | |
|---|---|---|---|
| D. 48,813 | 4/1916 | Dawson | D 9/392 |
| D. 208,625 | 9/1967 | Nohl et al. | D 9/373 X |
| D 224,639 | 8/1972 | Schieser et al. | D 9/374 |
| D. 264,937 | 6/1982 | Groark | D 9/349 |
| D 282,957 | 3/1986 | Carlson | D 9/374 X |
| 1,648,344 | 8/1927 | Hatcher | 215/1 R X |
| 1,824,229 | 9/1931 | Pevsner | 215/1 R X |
| 2,102,520 | 12/1937 | DeMontmorency | 222/478 X |
| 2,383,098 | 8/1945 | Wheaton Jr. | 215/1 R X |
| 2,978,131 | 4/1961 | Garvey | 215/1 R |
| 3,190,510 | 6/1965 | Gonzalez Jr. | 222/478 |
| 4,079,859 | 3/1978 | Jennings | 222/475 X |
| 4,691,822 | 9/1987 | Malancon Jr. | 220/94 A X |

FOREIGN PATENT DOCUMENTS

| | | | |
|---|---|---|---|
| 1437321 | 5/1976 | United Kingdom | 215/10 |

*Primary Examiner*—Sue A. Weaver
*Attorney, Agent, or Firm*—Chilton, Alix & Van Kirk

[57] ABSTRACT

A dispensing bottle for thick fluid, such as ketchup, in which the dispensing hole and cap are located in an enlarged, body portion of the bottle, near the base.

4 Claims, 2 Drawing Sheets

BOTTLE FOR DISPENSING VISCUOUS FOODSTUFF

BACKGROUND OF THE INVENTION

The present invention relates to bottle dispensers, and more particularly to a type of bottle suitable for dispensing thick liquids such as ketchup, salad dressing, and the like.

Conventional bottle dispensers typically have an enlarged body including a base for resting on a table or the like, and a slender neck portion extending upwardly from the body. A simple opening is provided at the top of the neck, for filling the bottle and for dispensing the fluid contents. A cap seals the opening between uses.

A common sight in restaurants and home kitchens is the frustration exhibited by users of conventional bottle dispensers as they attempt to shake out a suitable quantity of, for example ketchup, on a plate or item of food. This frustration is a result of the sometimes excruciatingly slow movement of fluid from the body portion of the container into the neck portion and through the opening, as the bottle is inverted and shaken. The long wait for the fluid to emerge is due in part to the "air gap" formed between the upper surface of the fluid and the opening when the bottle has been resting on its base since the previous use. Moreover, the inner surface of the neck of the bottle presents a high frictional resistance to the fluid, relative to the lower friction encountered if the neck surface were always "lined" with fluid. Finally, when dispensing bottles are first opened, pouring is very difficult because the narrow neck prevents pressure balancing behind the front boundary of the emerging fluid.

SUMMARY OF THE INVENTION

It is thus an object of the present invention to provide a bottle dispenser that reduces the delay in the pouring of the contents associated with conventional dispensers.

This object is accomplished in accordance with the invention, by locating the dispensing opening in the body portion of the bottle, adjacent the base. The neck portion of the bottle may optionally be provided with a conventional opening and cap. The primary purpose of the neck portion in accordance with the invention, is to serve as a stem or handle for holding or shaking the bottle to dispense the contents through the opening in the body portion.

An important advantage of the present invention is that the fluid in the bottle accumulates adjacent the dispensing opening when the bottle is not in use. The "air gap" mentioned above does not develop, and there is almost no neck wall friction to overcome. Rather than suffering the effect of gravity drawing the contents down and away from the dispensing opening when the bottle is not in use, the present invention takes advantage of gravity to draw the contents toward the dispensing opening when the bottle is not in use, thereby enabling immediate discharge when the dispensing cap is removed.

In the optional embodiment in which an opening in the neck is also provided, the cap on the neck can be loosened when the contents are poured through the primary dispensing opening in the base, in a manner that can control the pressure differential across the upper and lower exposed surface of the contents of the bottle.

The optional cap also permits easy filling or refilling of the bottle.

BRIEF DESCRIPTION OF THE DRAWINGS

These and other objects and advantages of the invention will become more evident from the following description of the preferred embodiment and accompanying drawings, in which.

DESCRIPTION OF THE PREFERRED EMBODIMENT

Figure 2:
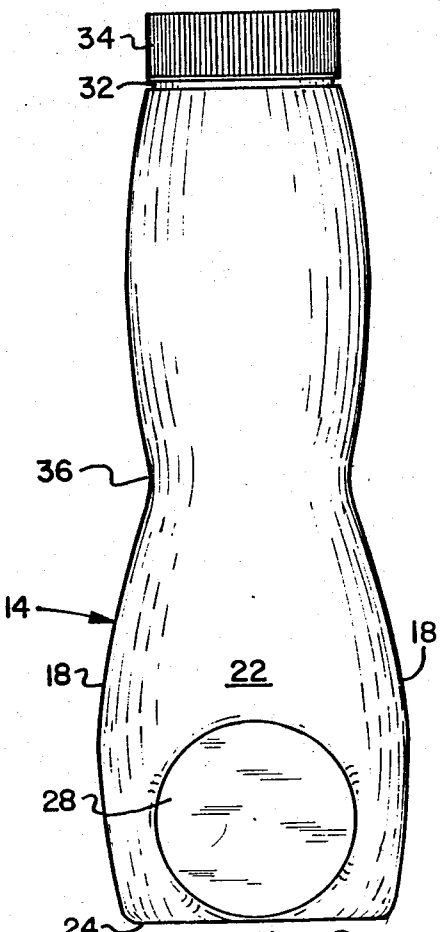
FIG. 2 is a side elevation view of the bottle dispenser of FIG. 1.
Figure 1:
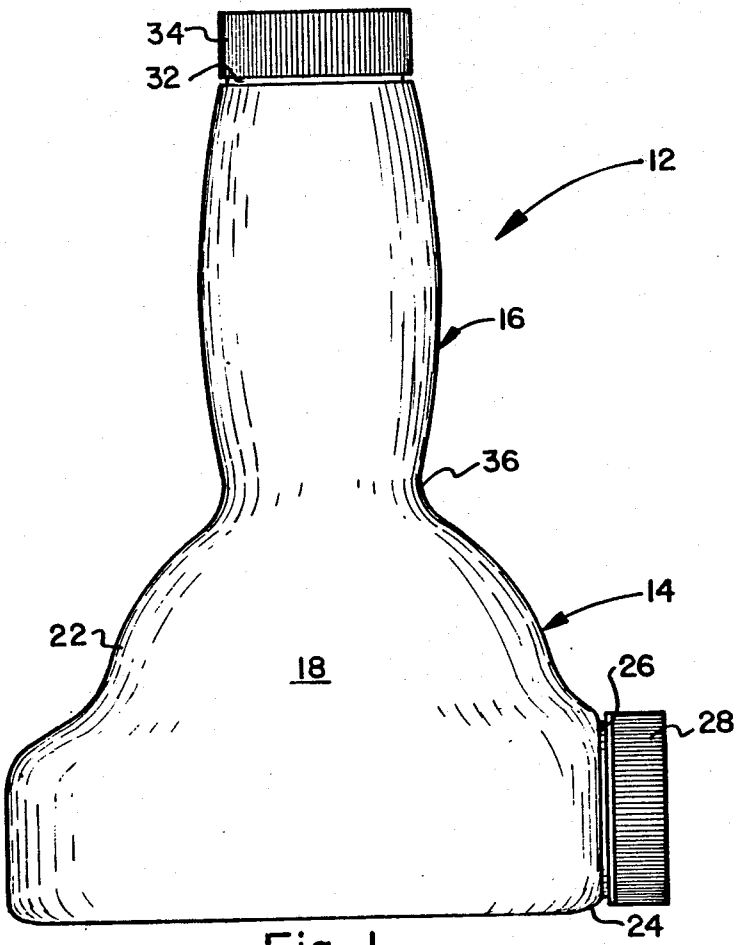
FIG. 1 is a front elevation view of a bottle dispenser according to the invention.

FIGS. 1 and 2 illustrate the preferred embodiment of the present invention. The bottle dispenser 12 includes an enlarged plastic body portion 14 and a narrower, elongated neck or stem portion 16 which extends preferably vertically above the body portion 14. The body portion 14 preferably has identical front and back walls 18, which substantially resemble the profile of a bell. The sidewalls 22 connect the front and rear walls together, as shown in FIG. 2.

The body portion 14 includes a substantially flat base portion 24 which is adapted to permit the stable positioning of the dispenser on a table or the like. Preferably, the distance between sidewalls 22 along the front wall 18 adjacent the base 24, is at least about twice the distance between the front and rear walls, along the sidewalls adjacent the base. Thus, the body portion 14 has a width dimension significantly larger than the depth dimension.

The body portion 14 includes a dispensing hole or similar device for manually selectively initiating flow through the aperture 26 situated near the base 24, and an associated cap 28, preferably of the conventional screw on type. It can be appreciated that when the body portion 14 contains fluid, such as ketchup or the like, the rest or storage position of the dispenser permits gravity-induced accumulation of the ketchup at the lower extent of the body portion, immediately adjacent the dispensing hole 26. When the contents are to be utilized, the user grasps the neck or stem portion 16 and merely removes the cap 26 such that the contents can be controllably poured onto the plate or an item of food. Since the contents are adjacent the dispensing hole 26 at the time the user picks up the bottle dispenser 12, very little effort is required to induce the fluid, however thick it may be, to quickly flow through the dispensing hole onto the food.

The stem portion 16 is preferably in the shape of an elongated barrel, adapted to be easily grasped in the palm of the hand. This portion is preferably several inches long, and, if hollow, forms an integral plastic chamber in fluid communication with the body portion 14 to increase the holding capacity of the dispenser. The handle as illustrated preferably includes a fill hole 32 and associated fill cap 34 which facilitates the initial filling of the container, or the refilling by the user. This fill hole 32 is optional, but has the additional advantage in that opening the fill cap 32 permits a pressure balance between the upper surface of the contents in the container and the lower surface adjacent the dispensing hole 26, which balance can facilitate the pouring of particularly thick fluids.

Figure 3:
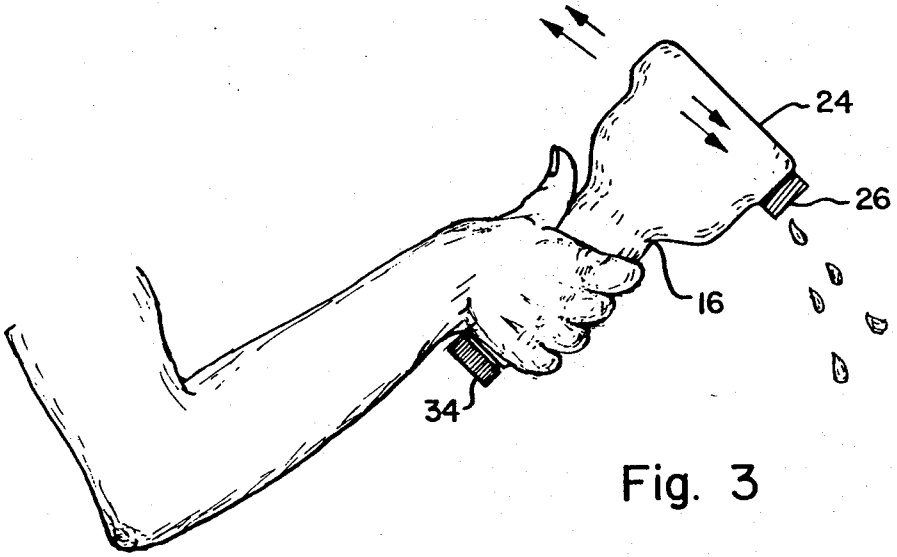
FIG. 3 is an illustration of the bottle in use.

As shown in FIG. 3, when the contents of the dispenser have been depleted until only a small amount remains, the dispenser may be grasped in the manner of grasping a hammer or the like, with the dispensing opening 26 facing downward, so that a more vigorous shaking action can be applied to remove the last servings of the contents of the dispenser. With a bottle having the dimensional relationships of the front and sidewalls as described above, the sidewall having the dispensing hole is relatively narrower than the front wall, and thus the dispensing hole 26 is more easily aimed at the target on the plate or the item of food.

The particular bottle dispenser described above has a generaly bell-shaped body portion 14 and a elongated, bell-shaped stem or handle portion 16. When viewed from the side, the bottle resembles two elongated barrels which intersect at the shoulder portion 36 of the body portion 14. It should be appreciated that other shaped may fall within the scope of the present invention. The common characteristic of the present invention is the location of the dispensing hole 26 in the body portion 14 adjacent the base 24. The particular shape of the base portion or the handle portion is of secondary importance. Accordingly, the appended claims should not be interpreted as limited by the shape of the dispensing bottle described herein.

I claim:

1. A bottle for dispensing viscuous foodstuff, comprising:

a hollow body portion including a base adapted to rest on a table or the like, for holding the viscuous foodstuff;

a hollow elongated stem portion in fluid communication with and extending upwardly from the body portion and adapted to be grasped in one hand for shaking the bottle in a direction transverse to the stem portion, the stem portion having a fill opening remote from the body portion and a selectively removable first closure;

means in the body portion for manually dispensing the foodstuff, said means including a discharge opening adjacent the base and a selectively removable second closure;

whereby viscuous foodstuff in the bottle can be selectively dispensed through the discharge opening by manually shaking the bottle in a direction transverse to the stem portion.

2. The dispensing bottle of claim 1, wherein the body portion has opposed front and rear walls that are substantially bell shaped and opposed sidewalls connecting the front and rear walls together.

3. The dispensing bottle of claim 2, wherein the stem portion is in the shape of an elongated barrel.

4. The dispensing bottle of claim 2, wherein the distance between sidewalls along the base of the body portion is at least twice the distance between the front and rear wall along the base.

* * * * *